US008434202B2

(12) United States Patent
Matsumoto

(10) Patent No.: US 8,434,202 B2
(45) Date of Patent: May 7, 2013

(54) SLIDE FASTENER

(76) Inventor: Masaki Matsumoto, Mie (JP)

( * ) Notice: Subject to any disclaimer, the term of this patent is extended or adjusted under 35 U.S.C. 154(b) by 0 days.

(21) Appl. No.: 13/412,031

(22) Filed: Mar. 5, 2012

(65) Prior Publication Data

US 2012/0159746 A1 Jun. 28, 2012

Related U.S. Application Data

(63) Continuation of application No. PCT/JP2010/006101, filed on Oct. 14, 2010.

(30) Foreign Application Priority Data

Nov. 10, 2009 (JP) ..... 2009-256917

(51) Int. Cl.
*A44B 19/02* (2006.01)

(52) U.S. Cl.
USPC ..... 24/386; 24/382; 24/399; 24/410; 24/428

(58) Field of Classification Search ..... 24/382, 24/383, 399, 401, 403, 405, 409, 410, 415, 24/427, 428, 585.1
See application file for complete search history.

(56) References Cited

U.S. PATENT DOCUMENTS 2,119,621 A * 6/1938 Ferrone ..... 2/96
2,229,216 A * 1/1941 Marinsky ..... 24/382
4,112,552 A * 9/1978 Lee ..... 24/382
4,485,534 A * 12/1984 Pilie et al. ..... 24/384
4,757,577 A * 7/1988 Freeman ..... 24/382
6,742,225 B2 * 6/2004 Marty et al. ..... 24/382
6,901,637 B2 * 6/2005 Machacek ..... 24/399

(Continued)

FOREIGN PATENT DOCUMENTS

JP 50-46305 U 5/1975
JP 51-88402 U 7/1976

(Continued)

OTHER PUBLICATIONS

International Search Report of PCT/JP2010/006101, mailing date Jan. 18, 2011.

*Primary Examiner* — Robert J Sandy
*Assistant Examiner* — Michael Lee
(74) *Attorney, Agent, or Firm* — Westerman, Hattori, Daniels & Adrian, LLP

(57) ABSTRACT

The slide fastener includes elements and a slider, wherein each of the elements includes a horizontal functional section an upper vertical functional section and a lower vertical functional section the slide fastener includes a plurality of fastener units in each of which the elements are arranged to oppositely face each other and the meshing portions are meshed with each other by sliding the slider between the oppositely-positioned elements, whereby the engagement pieces of the oppositely-positioned elements form an engagement portion and the engagement holding pieces of the oppositely-positioned elements in pair form an engagement holding portion, and the plurality of fastener units are constituted in a multilayered structure by engaging the engagement holding portions of a second fastener with the engagement portions of a first fastener such that the engagement holding portions of a new fastener unit are engaged with the engagement portions of a preceding fastener unit.

4 Claims, 12 Drawing Sheets

U.S. PATENT DOCUMENTS

| | | | | |
|---|---|---|---|---|
| 6,981,282 | B2 * | 1/2006 | Marty et al. | 2/69 |
| 6,993,792 | B2 * | 2/2006 | Marty et al. | 2/69 |
| 7,024,701 | B2 * | 4/2006 | Marty et al. | 2/96 |
| 2004/0055117 | A1 * | 3/2004 | Marty et al. | 24/382 |
| 2010/0269311 | A1 * | 10/2010 | Jacobsen | 24/382 |
| 2012/0096685 | A1 * | 4/2012 | Matsumoto | 24/406 |
| 2012/0096686 | A1 * | 4/2012 | Matsumoto | 24/410 |

FOREIGN PATENT DOCUMENTS

| | | | |
|---|---|---|---|
| JP | 51-95406 | U | 7/1976 |
| JP | 52-115305 | U | 9/1977 |
| JP | 52-144803 | U | 11/1977 |
| JP | 55-106107 | A | 8/1980 |
| JP | 10-501726 | A | 2/1998 |

* cited by examiner (a)

(b)

(a)

(b)

(a)

(b)

SLIDE FASTENER

TECHNICAL FIELD

The present invention relates to creation of a fastener element having a specific shape, and to a slide fastener having a multilayered structure made up of plural fastener units with one fastener unit overlaid on another fastener unit in succession.

BACKGROUND ART

Many existing slide fasteners are primarily attached to openings of clothes, bags, etc., and they have a single-layer structure that elements are arranged in a line along each of edges of the opening and, by moving a slider between left and right elements in pair, which constitute one set of elements, the left and right elements are successively meshed with each other for closing of the slide fastener in a freely openable manner. Meanwhile, a slide fastener including fasteners provided one above another in plural layers is also known to be adapted for clothes, bags, etc., which are required to have waterproof properties and are required to be safe. (see, e.g., Japanese unexamined utility model registration application Publication Nos. 52-115305 and 52-144803

SUMMARY OF INVENTION

However, because the slide fasteners disclosed in Japanese unexamined utility model registration application Publication Nos. 52-115306 and 52-144803 have a structure that the fasteners provided one above another in plural layers are opened and closed by one slider, even when the fastener provided in one layer is to be opened and closed, the fasteners provided in plural layers have to be opened and closed at the same time. A novel slide fastener is provided having a multilayered structure made up of plural fastener units with one fastener unit overlaid on another fastener unit in succession, by creating a fastener element having a specific shape A slide fastener according to a first aspect comprises elements, which are arranged in a line along each of oppositely-positioned edges of opening/closing ends of fastener tapes, and a slider, the slide fastener being opened and closed by sliding the slider between the elements, wherein each of the elements includes a horizontal functional section having a meshing portion on one side and a fastener-tape fixed portion on the other side in the horizontal direction, an upper vertical functional section having an engagement piece that is formed by extending the meshing portion upwards perpendicularly to the horizontal functional section, and a lower vertical functional section having an engagement holding piece that is formed by extending the fastener-tape fixed portion downwards perpendicularly to the horizontal functional section, the slide fastener includes a plurality of fastener units in each of which the elements are arranged to oppositely face each other and the meshing portions are meshed with each other by sliding the slider between the oppositely-positioned elements, whereby the engagement pieces of the oppositely-positioned elements in pair form an engagement portion and the engagement holding pieces of the oppositely-positioned elements in pair form an engagement holding portion, and the plurality of fastener units are constituted in a multilayered structure by engaging the engagement holding portions of a second fastener unit with the engagement portions of a first fastener unit such that the engagement holding portions of a new fastener unit are engaged with the engagement portions of a preceding fastener unit in succession.

In a slide fastener according to a second aspect, in addition to the features of the slide fastener according to the first aspect, the engagement portion has an arrow-head shape including a pointed tip at a distal end thereof, and the engagement holding portion is provided by forming each of the downwards-extended engagement holding pieces into a hook-like shape and has a pyramidal shape for engagement with the engagement portion having the arrow-head shape.

In a slide fastener according to a third aspect, in addition to the features of the slide fastener according to the first aspect, the engagement portion has an arrow-head shape including a pointed tip at a distal end thereof and includes a recess formed at an underside of the arrow-head shape, and the engagement holding portion is provided by forming each of the downwards-extended engagement holding pieces into a hook-like shape with elasticity, and by forming a projection to be engageable with the recess, the engagement holding portion having a pyramidal shape such that the engagement holding portion is engaged with the engagement portion having the arrow-head shape by pushing-in.

In a slide fastener according to a fourth aspect, in addition to the features of the slide fastener according to the first aspect, the engagement portion has a flat head shape including a flat surface at a distal end thereof, and the engagement holding portion has a parallelepiped shape provided by forming each of the downwards-extended engagement holding pieces into a square-channel shape such that the engagement portion having the flat head shape is prevented from being pushed in and engaged with the engagement holding portion by an external force.

According to the slide fastener according to the first aspect, the slide fastener comprises elements, which are arranged in a line along each of oppositely-positioned edges of opening/closing ends of fastener tapes, and a slider, the slide fastener being opened and closed by sliding the slider between the elements, wherein each of the elements includes a horizontal functional section having a meshing portion on one side and a fastener-tape fixed portion on the other side in the horizontal direction, an upper vertical functional section having an engagement piece that is formed by extending the meshing portion upwards perpendicularly to the horizontal functional section, and a lower vertical functional section having an engagement holding piece that is formed by extending the fastener-tape fixed portion downwards perpendicularly to the horizontal functional section, the slide fastener includes a plurality of fastener units in each of which the elements are arranged to oppositely face each other and the meshing portions are meshed with each other by sliding the slider between the oppositely-positioned elements, whereby the engagement pieces of the oppositely-positioned elements in pair form an engagement portion and the engagement holding pieces of the oppositely-positioned elements in pair form an engagement holding portion, and the plurality of fastener units are constituted in a multilayered structure by engaging the engagement holding portions of a second fastener unit with the engagement portions of a first fastener unit such that the engagement holding portions of a new fastener unit are engaged with the engagement portions of a preceding fastener unit in succession. Therefore, a novel slide fastener can be provided which has the multilayered structure made up of the plural fastener units with one fastener unit overlaid on another fastener unit in succession. Further, since the fastener units constituting respective layers of the multilayered structure are engaged with each other, meshing positions of the elements are specified when the elements are meshed with each other, and a stable meshed state can be held.

According to the slide fastener according to the second aspect, since the engagement portion has an arrow-head shape including a pointed tip at a distal end thereof and the engagement holding portion is provided by forming each of the downwards-extended engagement holding pieces into a hook-like shape and has a pyramidal shape for engagement with the engagement portion having the arrow-head shape, the plural fastener units can be stacked one above another in the multilayered structure.

According to the slide fastener according to the third aspect, since the engagement portion has an arrow-head shape including a pointed tip at a distal end thereof and includes a recess formed at an underside of the arrow-head shape, and the engagement holding portion is provided by forming each of the downwards-extended engagement holding pieces into a hook-like shape with elasticity, and by forming a projection to be engageable with the recess, the engagement holding portion having a pyramidal shape such that the engagement holding portion is engaged with the engagement portion having the arrow-head shape by pushing-in, the plural fastener units can be stacked one above another even after the fastener units have been closed. Further, since the engagement portions are grasped by the engagement holding portions with elasticity thereof from the left and the right, and the projections are engaged in the recesses that are formed, at the underside of the arrow-head shape, in the engagement portions of the first fastener unit. As a result, the stacked first and second fastener units are not easily disengaged from each other.

According to the slide fastener according to the fourth aspect, since the engagement portion has a flat head shape including a flat surface at a distal end thereof and the engagement holding portion has a parallelepiped shape provided by forming each of the downwards-extended engagement holding pieces into a square-channel shape such that the engagement portion having the flat head shape is prevented from being pushed in and engaged with the engagement holding portion by an external force, the fastener units can be prevented, in a state where they are meshed individually without being stacked, from being engaged with each other in an event that the engagement portion of one fastener unit is unintentionally pushed into and engaged with the engagement holding portion of the other fastener unit by an external force.

BRIEF DESCRIPTION OF DRAWINGS

FIG. 10 is an explanatory view illustrating a state in the course of an operation of overlaying fastener units using the elements according to the second embodiment one above another by pushing-in.

FIG. 11 is an explanatory view illustrating a state where the fastener units using the elements according to the second embodiment have been overlaid one above another by pushing-in.

DETAILED DESCRIPTION OF THE INVENTION

Figure 1:
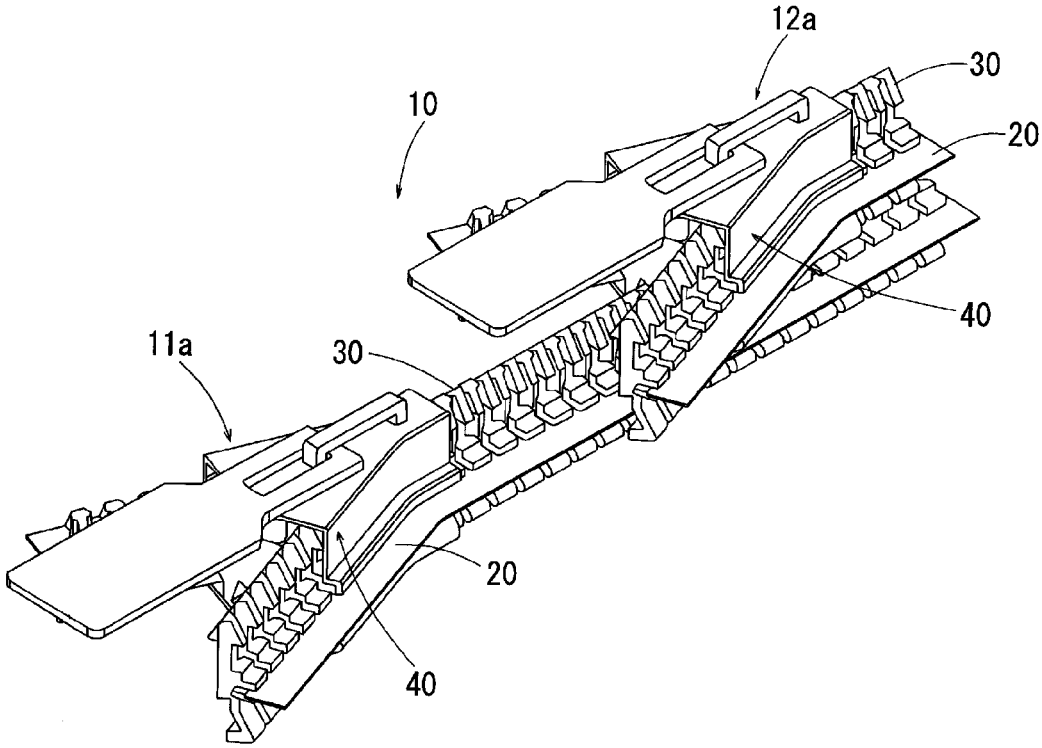
FIG. 1 is a perspective view illustrating an embodiment of a slide fastener.

An embodiment of a slide fastener according to the present invention will be described in detail below with reference to the drawings. As illustrated in FIG. 1, a slide fastener 10 includes a plurality of fastener units 11*a* and 12*a* each constituted by elements 30, which are arranged in a line along each of oppositely-positioned edges of opening/closing ends of fastener tapes 20, and by a slider 40. A new fastener unit is overlaid on another preceding fastener unit in succession, such as by engaging the second fastener unit 12*a* with the first fastener unit 11*a*, to thereby provide a multilayered structure made up of plural fastener units.

Details of the element 30 and the slider 40, both constituting the slide fastener, will be described below with reference to FIGS. 2(*a*) and 2(*b*), FIG. 3, and FIGS. 4(*a*), 4(*b*), 4(*c*), 4 (d) and 4(*e*).

Figure 2:
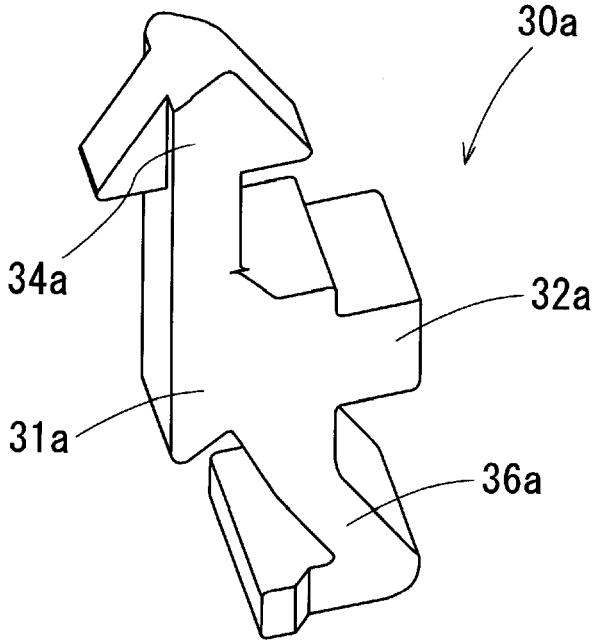
FIG. 2 illustrates a first embodiment of an element; specifically, FIG. 2(*a*) is a perspective view of a single element, and FIG. 2(*b*) is a perspective view of two elements meshed in opposing relation.
Figure 2:
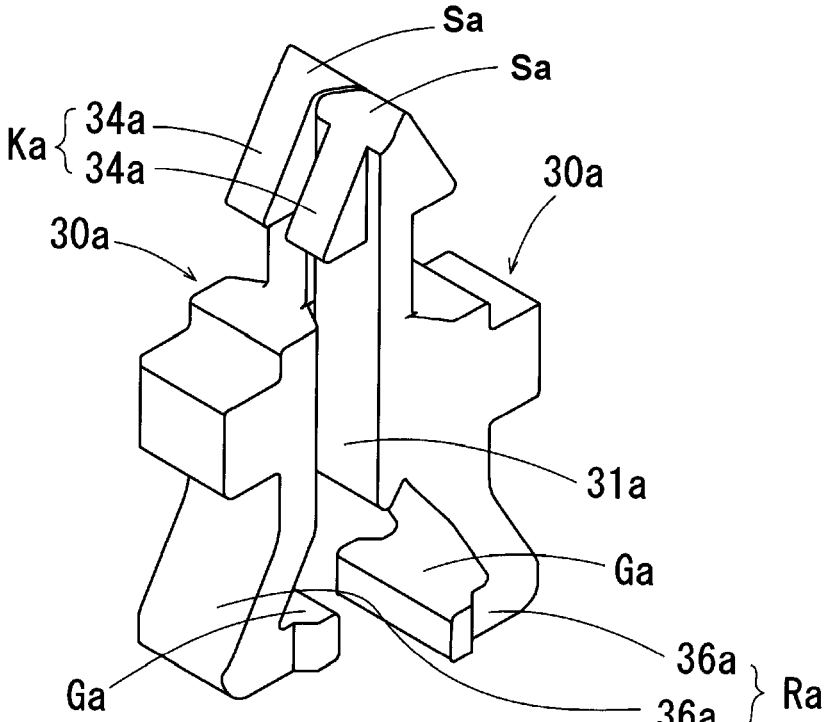

FIG. 2(*a*) illustrates an element 30*a* according to a first embodiment. The element 30*a* includes a horizontal functional section having a meshing portion 31*a* on one side and a fastener-tape fixed portion 32*a* on the other side in the horizontal direction, an upper vertical functional section having an engagement piece 34*a* that is formed by extending the meshing portion 31*a* upwards perpendicularly to the horizontal functional section, and a lower vertical functional section having an engagement holding piece 36*a* that is formed by extending the fastener-tape fixed portion 32*a* downwards perpendicularly to the horizontal functional section.

The elements 30*a* each having the above-described structure are arranged to oppositely face each other as illustrated in FIG. 2(*b*), and the meshing portions 31*a* are meshed with each other by sliding the slider, described below, between the oppositely-positioned elements 30*a*, whereby the engagement pieces 34*a* of the oppositely-positioned elements 30*a* in pair form an engagement portion Ka and the engagement holding pieces 36*a* of the oppositely-positioned elements 30*a* in pair form an engagement holding portion Ra. Further, the engagement portion Ka has an arrow-head shape including a pointed tip Sa for each element at a distal end thereof. The engagement holding portion Ra is provided by forming each of the downwards-extended engagement holding pieces 36*a* into a hook-like shape Ga, and it has a pyramidal shape for engagement with the engagement portion Ka having the arrow-head shape.

Figure 3:
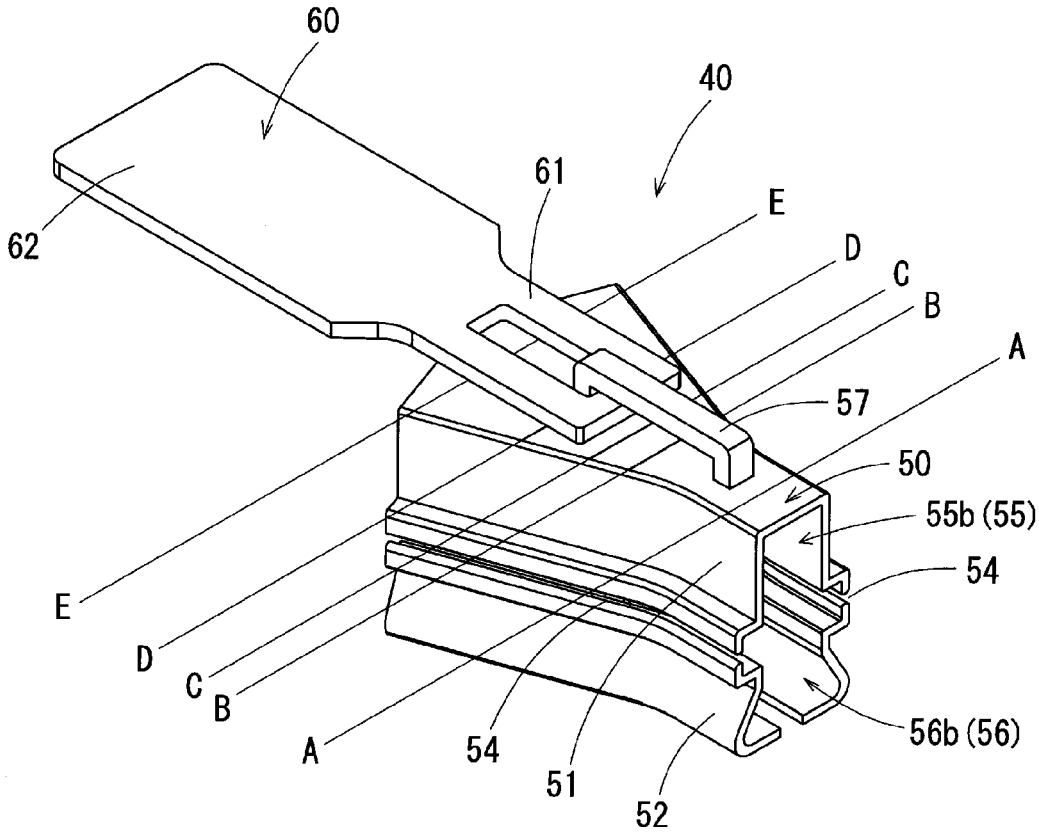
FIG. 3 is a perspective view illustrating an embodiment of a slider.

FIG. 3 illustrates an embodiment of the slider 40. The slider 40 is constituted by a slider body 50 through which the elements 30*a* are moved for meshing and unmeshing, and a pull 60 used for moving the slider body 50.

Figure 4:
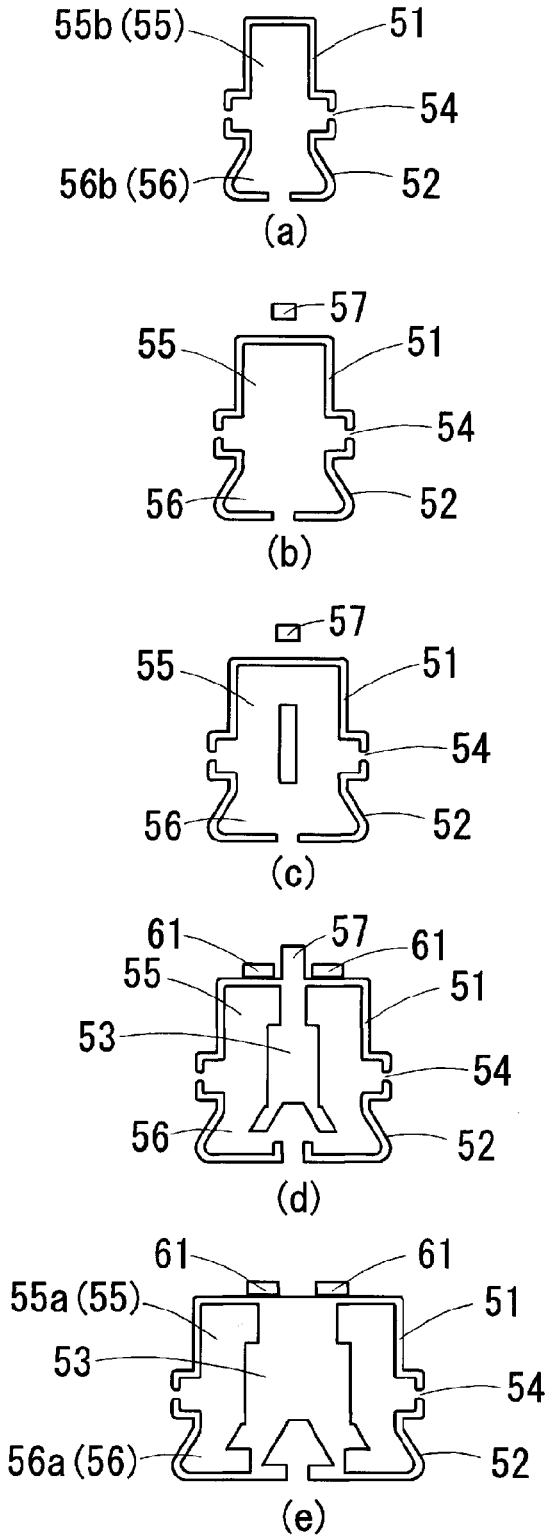
FIGS. 4(*a*) to 4(*e*) are sectional views of the slider, taken respectively along linear lines A to E in FIG. 3.

FIGS. 4(*a*) to 4(*e*) are sectional views of the slider body 50 taken along linear lines A to E in FIG. 3, respectively. The slider body 50 is made up of an upper vertical case 51 (FIGS. 4(*a*) to 4(*e*)), a lower vertical case (FIGS. 4(*a*) to 4(*e*)), and a coupling portion 53 (FIG. 4(*e*)) for coupling both the cases 51 and 52. A horizontal slit 54 through which a fastener tape 20 is inserted is formed between the upper vertical case 51 and the lower vertical case 52 (FIGS. 4(*a*) to 4(*e*)).

Inside the slider body 50, element passages 55 and 56 are formed respectively in the upper vertical case 51 and the lower vertical case 52, and the plural elements 30*a* arranged in a line along each of oppositely-positioned edges of opening/closing ends of the fastener tapes 20 are inserted through each of the element passages 55 and 56. A portion 55*a* (FIG. 4(*e*)) of the element passage 55 in the upper vertical case 51 on one side allows the insertion of the engagement pieces 34*a* of the elements 30*a* therethrough before the elements 30*a* are meshed with each other, and a portion 55*b* (FIGS. 3 and 4(*a*)) of the element passage 55 on the other side allows the insertion of the engagement pieces 34*a* of the elements 30*a* therethrough after the elements 30*a* have been meshed with each other.

Similarly, a portion 56*a* (FIG. 4(*e*)) of the element passage 56 in the lower vertical case 52 on one side allows the insertion of the engagement holding pieces 36*a* of the elements 30*a* therethrough before the elements 30*a* are meshed with each other, and a portion 56*b* (FIGS. 3 and 4(*a*)) of the element passage 56 on the other side allows the insertion of the engagement holding pieces 36*a* of the elements 30*a* therethrough after the elements 30*a* have been meshed with each other.

The pull 60 is made up of an attachment portion 61 for attachment to the slider body 50, and a thumb 62, the attachment portion 61 being engaged with a pull attachment portion 57 that is vertically provided on the upper vertical case 51 (FIG. 3).

The operation of the slide fastener constituted by the elements 30*a* and the slider 40, both described above as the first embodiment, will be described below with reference to FIGS. 5 and 6.

Figure 5:
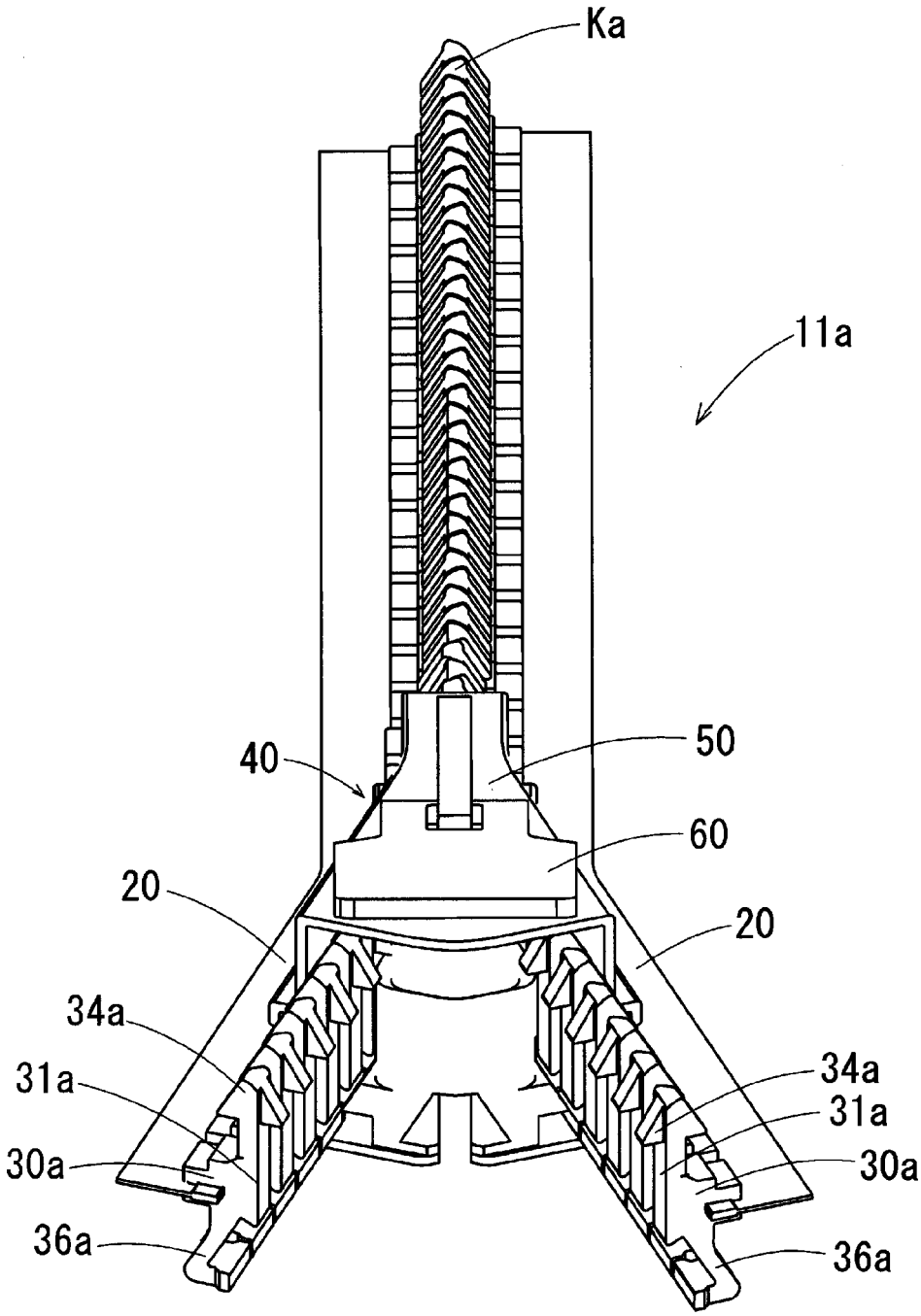
FIG. 5 is an explanatory view to explain an operation of forming a first fastener unit.

FIG. 5 is an explanatory view to explain an operation of forming the first fastener unit 11*a*. The slider 40 of the first fastener unit 11*a* is slid along the element passage 55 (FIGS. 4(*a*) to 4(*e*)) in the upper vertical case (FIGS. 4(*a*) to 4(*e*)) of the slider body 50 between the meshing portions 31*a* and the upwards-extended engagement pieces 34*a* of the elements 30*a*, which are arranged in a line along each of the oppositely-positioned edges of the opening/closing ends of the oppositely-arranged fastener tapes 20 of the first fastener unit 11*a*. With the sliding of the slider 40, the oppositely-positioned meshing portions 31*a* are meshed with each other such that the engagement pieces 34*a* of the oppositely-positioned elements form the engagement portions Ka and the engagement holding pieces 36*a* of the oppositely-positioned elements form the engagement holding portions Ra (FIG. 2(*b*)), whereby the first fastener unit 11*a* is formed.

Figure 6:
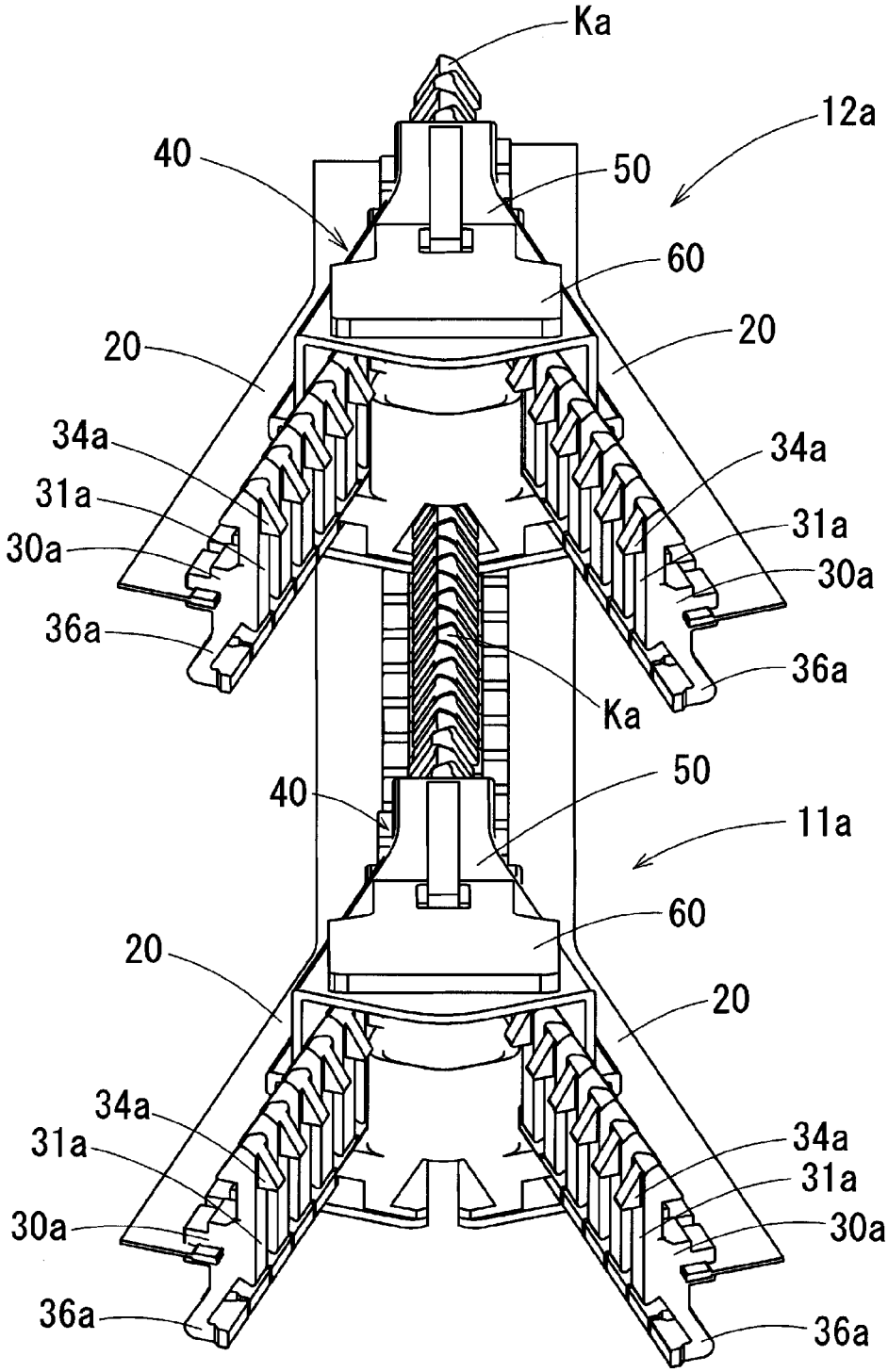
FIG. 6 is an explanatory view to explain an operation of forming a second fastener unit in a state overlying the first fastener unit, which has been formed as illustrated in FIG. 5, thereby providing a multilayered structure of those fastener units.

FIG. 6 is an explanatory view to explain an operation of similarly forming a second fastener unit 12*a* in a state overlaying the first fastener unit 11*a*, which has been formed as illustrated in FIG. 5, thereby providing a multilayered structure of those fastener units. The slider 40 of the second fastener unit 12*a* is slid along the element passage 55 (FIGS. 4(*a*) to 4(*e*)) in the upper vertical case (FIGS. 4(*a*) to 4(*e*)) of the slider body 50 between the meshing portions 31*a* and the upwards-extended engagement pieces 34*a* of the elements 30*a*, which are arranged in a line along each of the oppositely-positioned edges of the opening/closing ends of the oppositely-arranged fastener tapes 20 of the second fastener unit 12*a*. With the sliding of the slider 40, the oppositely-positioned meshing portions 31*a* are meshed with each other such that the engagement pieces 34*a* of the oppositely-positioned elements form the engagement portions Ka and the engagement holding pieces 36*a* of the oppositely-positioned elements form the engagement holding portions Ra, whereby the second fastener unit 12*a* is formed. When the slider 40 of the second fastener unit 12*a* is slid, the engagement portions Ka of the first fastener unit 11*a* are caused to slide through inner spaces of the engagement holding portions Ra of the second fastener unit 12*a*, those engagement holding portions Ka being formed in the element passage 56 (FIGS. 4(*a*) to 4(*e*)) in the lower vertical case 52 (FIGS. 4(*a*) to 4(*e*)) of the slider body 50 of the second fastener unit 12*a*. Thus, the first fastener unit 11*a* and the second fastener unit 12*a* are engaged with each other to provide the multilayered structure.

The engagement portion Ka has an arrow-head shape including the pointed tip Sa (FIG. 2(*b*)) for each element at the distal end thereof. The engagement holding portion Ra (FIG. 2(*b*)) is provided by forming each of the downwards-extended engagement holding pieces 36*a* into the hook-like shape Ga (FIG. 2(*b*)), and it has a pyramidal shape for engagement with the engagement portion Ka having the arrow-head shape.

Figure 7:
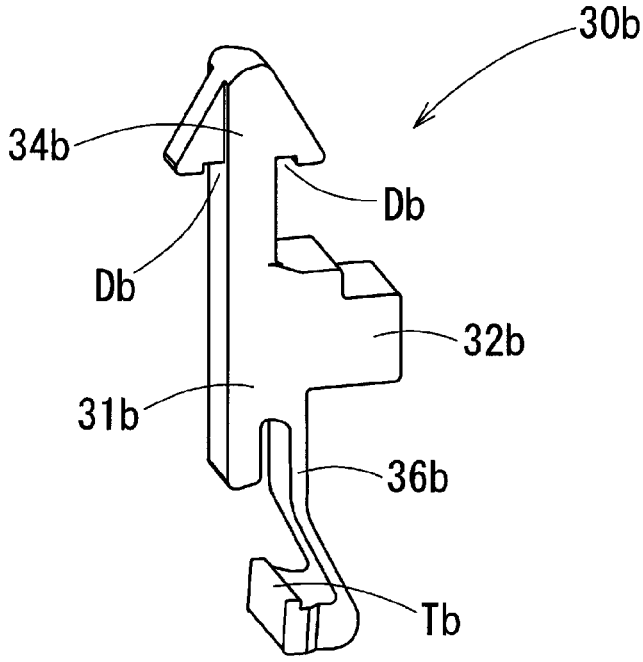
FIG. 7 illustrates a second embodiment of the element; specifically, FIG. 7(*a*) is a perspective view of a single element, and FIG. 7(*b*) is a perspective view of two elements meshed in opposing relation.
Figure 7:
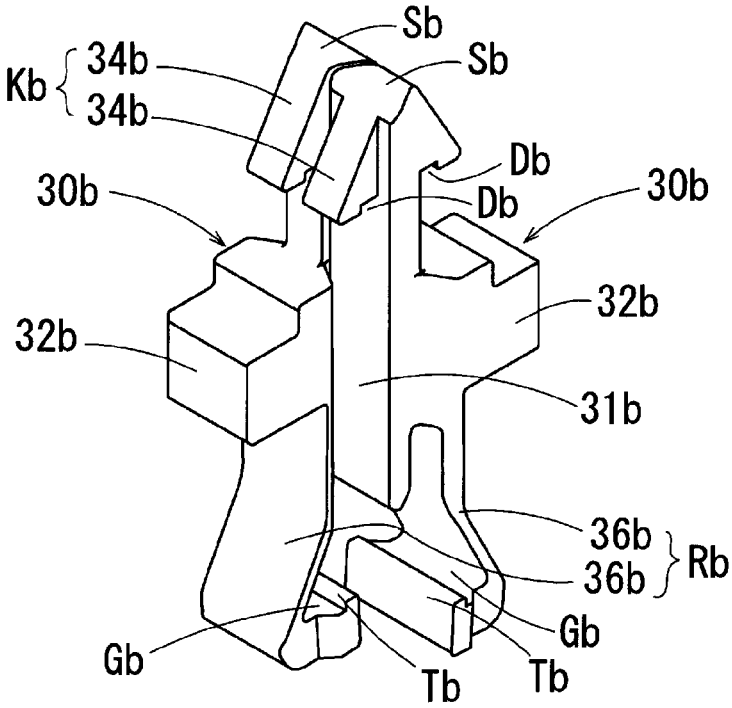

Another embodiment of the element will be described below with reference to FIGS. 7 and 8. FIG. 7(*a*) illustrates an element 30*b* according to a second embodiment. The element 30*b* includes a horizontal functional section having a meshing portion 31*b* on one side and a fastener-tape fixed portion 32*b* on the other side in the horizontal direction, an upper vertical functional section having an engagement piece 34*b* that is formed by extending the meshing portion 31*b* upwards perpendicularly to the horizontal functional section, and a lower vertical functional section having an engagement holding piece 36*b* that is formed by extending the fastener-tape fixed portion 32*b* downwards perpendicularly to the horizontal functional section.

The elements 30*b* each having the above-described structure are arranged to oppositely face each other and the meshing portions 31*b* are meshed with each other by sliding the slider 40 between the oppositely-positioned elements 30*a*, whereby the engagement pieces 34*b* of the oppositely-positioned elements 30*b* form an engagement portion Kb and the engagement holding pieces 36*b* of the oppositely-positioned elements 30*b* form an engagement holding portion Rb, as illustrated in FIG. 7(*b*).

Further, the engagement portion Kb has an arrow-head shape including a pointed tip Sb for each element at a distal end thereof, and it includes recesses Db formed at the underside of the arrow-head shape. The engagement holding portion Rb is provided by forming each of the downwards-extended engagement holding pieces 36*b* into a hook-like shape Gb with elasticity, and by forming a projection Tb to be engageable with the recess Db. The engagement holding portion Rb has a pyramidal shape such that it can be engaged with the engagement portion Kb having the arrow-head shape by pushing-in.

Figure 8:
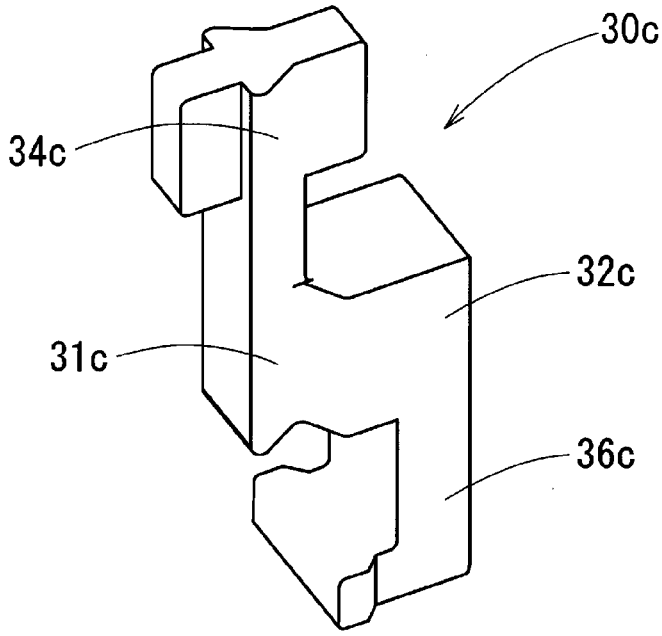
FIG. 8 illustrates a third embodiment of the element; specifically, FIG. 8(*a*) is a perspective view of a single element, and FIG. 8(*b*) is a perspective view of two elements meshed in opposing relation.
Figure 8:
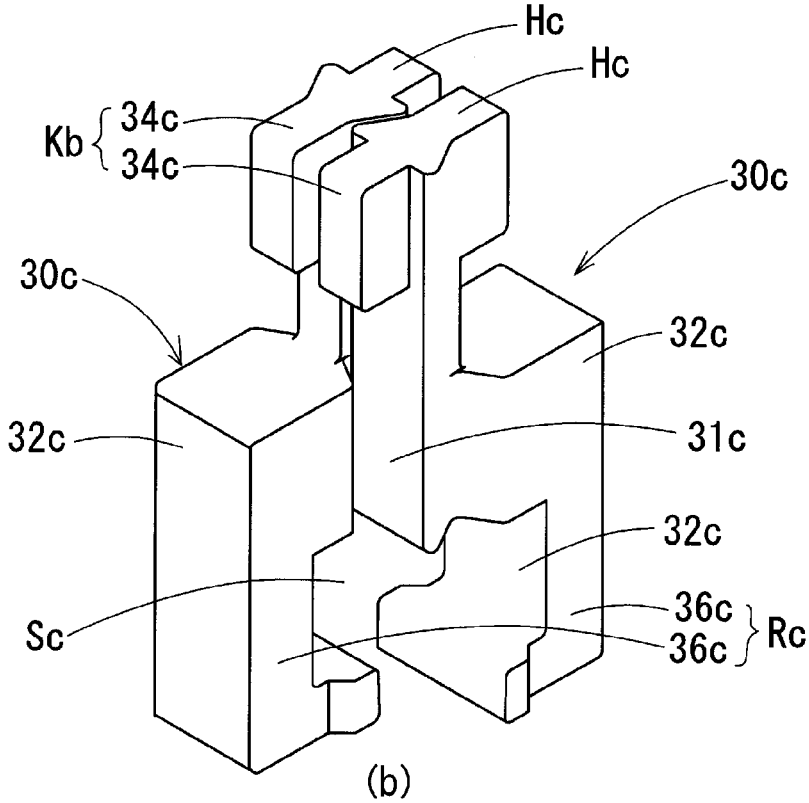

FIG. 8(*a*) illustrates an element 30*c* according to a third embodiment. The element 30*c* includes a horizontal functional section having a meshing portion 31*c* on one side and a fastener-tape fixed portion 32*c* on the other side in the horizontal direction, an upper vertical functional section having an engagement piece 34*c* that is formed by extending the meshing portion 31*c* upwards perpendicularly to the horizontal functional section, and a lower vertical functional section having an engagement holding piece 36*c* that is formed by extending the fastener-tape fixed portion 32*c* downwards perpendicularly to the horizontal functional section.

The elements 30*c* each having the above-described structure are arranged to oppositely face each other and the meshing portions 31*c* are meshed with each other by sliding the slider 40 between the oppositely-positioned elements 30*c*, whereby the engagement pieces 34*c* of the oppositely-positioned elements 30*c* form an engagement portion Kc and the engagement holding pieces 36*c* of the oppositely-positioned elements 30*c* form an engagement holding portion Rc, as illustrated in FIG. 8(*b*).

Further, the engagement portion Kc has a flat head shape including a flat surface Hc for each element at a distal end thereof. The engagement holding portion Rc has a parallelepiped shape provided by forming each of the downwards-extended engagement holding pieces 36*c* into a square-channel shape Sc for engagement with the engagement portion Kc.

Operations of overlaying fastener units one above another with the aid of the elements according to the first to third embodiments will be described below with reference to FIGS. 2(*a*) and 2(*b*), FIG. 3, FIGS. 4(*a*), 4(*b*), 4(*c*), 4(*d*) and 4(*e*), FIGS. 6(*a*) and 6(*b*), FIGS. 7(*a*) and 7(*b*), FIGS. 8(*a*) and 8(*b*), and FIGS. 9 to 12.

Figure 9:
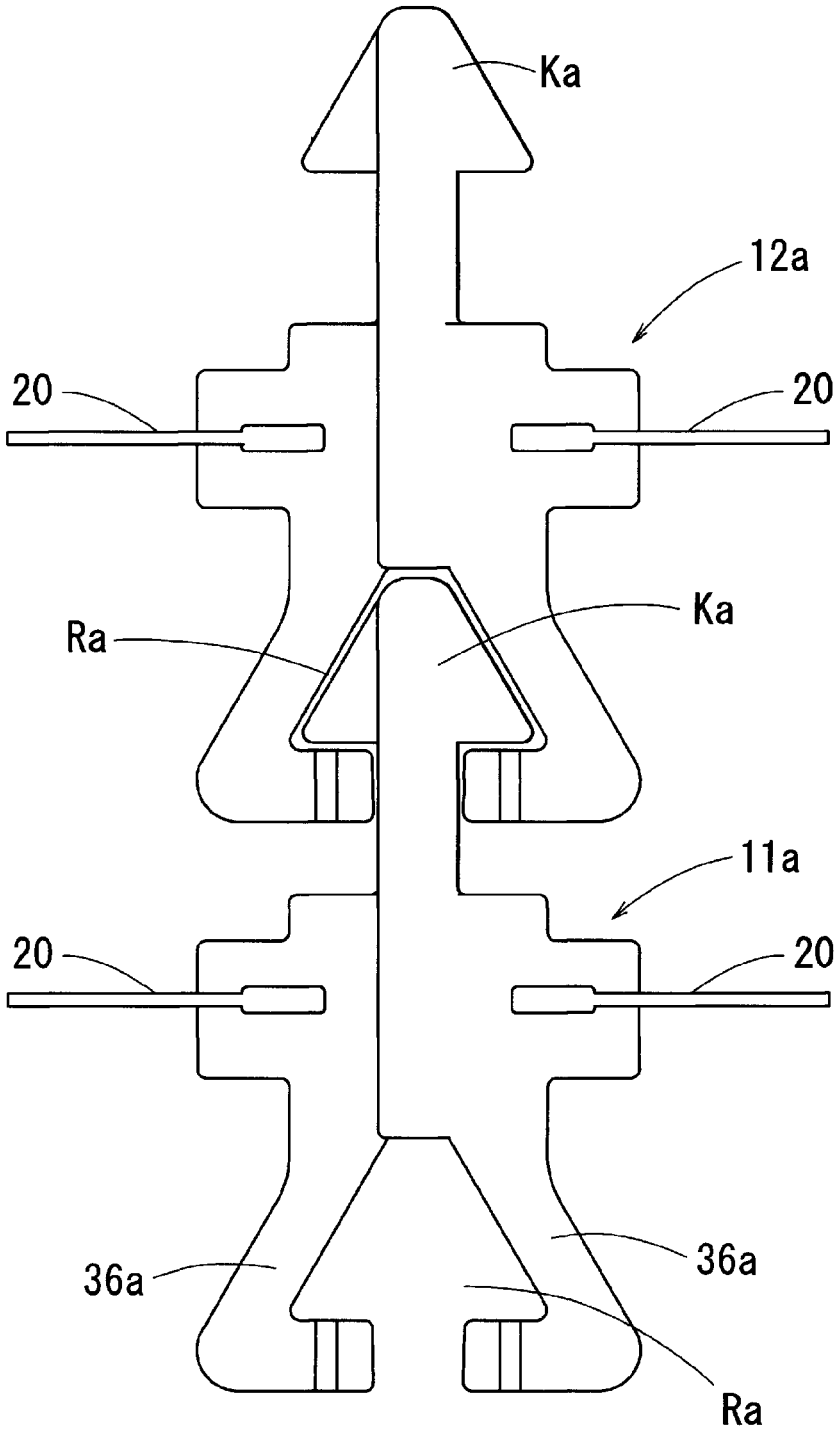
FIG. 9 is an explanatory view illustrating a state where fastener units using the elements according to the first embodiment are overlaid one above another.

FIG. 9 illustrates a state where the fastener units 11*a* and 12*a* using the elements 30*a* (FIG. 2(*a*)) according to the first embodiment are overlaid one above another. As described above, the elements 30*a* (FIG. 2(*a*)) are arranged to oppositely face each other, and the slider 40 (FIG. 3) is slid along not only the element passage 55 (FIGS. 4(*a*) to 4(*e*)) in the upper vertical case 51 (FIGS. 3 and 4(*a*) to 4(*e*)) of the slider body 50 (FIG. 3) between the meshing portions 31*a* (FIG. 2(*a*)) and the upwards-extended engagement pieces 34*a* (FIG. 2(*a*)), but also along the element passage 56 (FIGS. 4(*a*) to 4(*e*)) in the lower vertical case 52 (FIGS. 3 and 4(*a*) to 4(*e*)) of the slider body 50 (FIG. 3) between the meshing portions 31*a* (FIG. 2(*a*)) and the downwards-extended engagement holding pieces 36*a* (FIG. 2(*a*)). With the sliding of the slider 40, the oppositely-positioned meshing portions 31*a* (FIG. 2(*a*)) are meshed with each other such that the engagement pieces 34*a* (FIG. 2(*a*)) of the oppositely-positioned elements form the engagement portions Ka (FIG. 2(*b*)) and the engagement holding pieces 36*a* (FIG. 2(*a*)) of the oppositely-positioned elements form the engagement holding portions Ra (FIG. 2(*b*)), whereby the first fastener unit 11*a* is formed.

Similarly, the other elements 30*a* (FIG. 2(*a*)) are arranged to oppositely face each other, and the other slider (FIG. 3) is slid along not only the element passage 55 (FIGS. 4(*a*) to 4(*e*)) in the upper vertical case 51 (FIGS. 3 and 4(*a*) to 4(*e*)) of the slider body 50 (FIG. 3) between the meshing portions 31*a* (FIG. 2(*a*)) and the upwards-extended engagement pieces 34*a* (FIG. 2(*a*)), but also along the element passage 56 (FIGS. 4(*a*) to 4(*e*)) in the lower vertical case 52 (FIGS. 3 and 4(*a*) to 4(*e*)) of the slider body 50 (FIG. 3) between the meshing portions 31*a* (FIG. 2(*a*)) and the downwards-extended engagement holding pieces 36*a* (FIG. 2(*a*)). With the sliding of the slider 40, the oppositely-positioned meshing portions 31*a* (FIG. 2(*a*)) are meshed with each other such that the engagement pieces 34*a* (FIG. 2(*a*)) of the oppositely-positioned elements form the engagement portions Ka (FIG. 2(*b*)) and the engagement holding pieces 36*a* (FIG. 2(*a*)) of the oppositely-positioned elements form the engagement holding portions Ra (FIG. 2(*b*)), whereby the second fastener unit 12*a* is formed.

When the second fastener unit 12*a* is formed, the engagement holding portions Ra of the second fastener unit 12*a* can be engaged with the engagement portions Ka of the first fastener unit 11*a* in grasping relation such that the second fastener unit 12*a* is overlaid on the first fastener unit 11*a*.

Thus, a novel slide fastener can be provided which has a multilayered structure made up of plural fastener units by overlaying one fastener unit overlaid on another fastener unit, i.e., by engaging the engagement holding portions of a new fastener unit with the engagement portions of a preceding fastener unit in succession.

Figure 10:
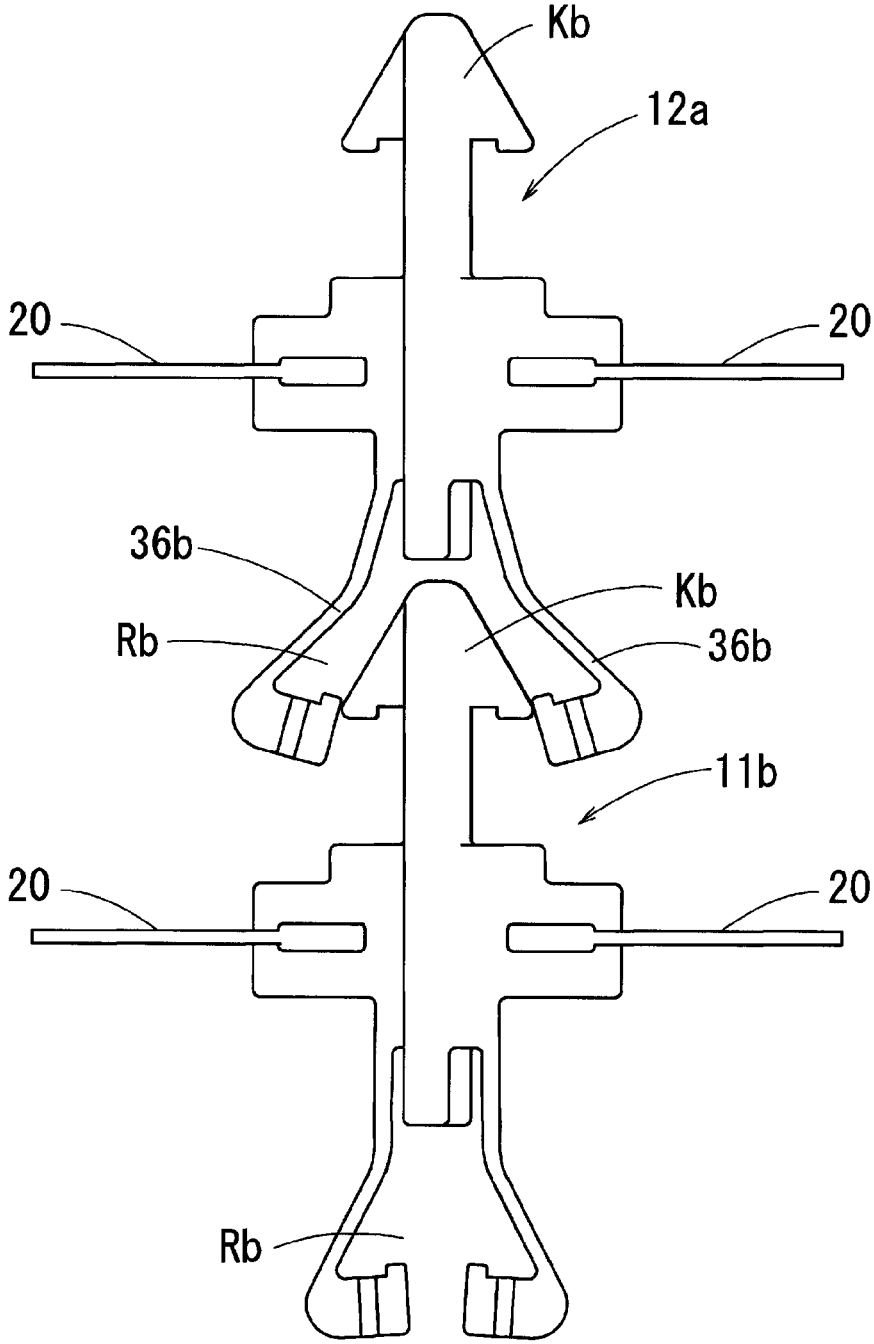

FIG. 10 illustrates a state in the course of an operation of overlaying fastener units 11*b* and 12*b* using the elements 30*b* (FIG. 6(*a*)) according to the second embodiment one above another by pushing-in. The elements 30*b* (FIG. 6(*a*)) are arranged to oppositely face each other, and the slider 40 (FIG. 3) is slid along not only the element passage 55 (FIGS. 4(*a*) to 4(*e*)) in the upper vertical case (FIGS. 3 and 4(*a*) to 4(*e*)) of the slider body 50 (FIG. 3) between the meshing portions 31*b* (FIG. 6(*a*)) and the upwards-extended engagement pieces 34*b* (FIG. 6(*a*)), but also along the element passage 56 (FIGS. 4(*a*) to 4(*e*)) in the lower vertical case 52 (FIGS. 3 and 4(*a*) to 4(*e*)) of the slider body 50 (FIG. 3) between the meshing portions 31*b* (FIG. 6(*a*)) and the downwards-extended engagement holding pieces 36*b* (FIG. 6(*a*)). With the sliding of the slider 40, the oppositely-positioned meshing portions 31*b* (FIG. 6(*a*)) are meshed with each other such that the engagement pieces 34*b* (FIG. 6(*a*)) of the oppositely-positioned elements form the engagement portions Kb (FIG. 6(*b*)) and the engagement holding pieces 36*b* (FIG. 6(*a*)) of the oppositely-positioned elements form the engagement holding portions Rb (FIG. 6(*b*)), whereby the first fastener unit 11*b* is formed.

Similarly, the other elements 30*b* (FIG. 6(*a*)) are arranged to oppositely face each other, and the other slider (FIG. 3) is slid along not only the element passage 55 (FIGS. 4(*a*) to 4(*e*)) in the upper vertical case 51 (FIGS. 3 and 4(*a*) to 4(*e*)) of the slider body 50 (FIG. 3) between the meshing portions 31*b* (FIG. 6(*a*)) and the upwards-extended engagement pieces 34*b* (FIG. 6(*a*)), but also along the element passage 56 (FIGS. 4(*a*) to 4(*e*)) in the lower vertical case 52 (FIGS. 3 and 4(*a*) to 4(*e*)) of the slider body 50 (FIG. 3) between the meshing portions 31*b* (FIG. 6) and the downwards-extended engagement holding pieces 36*b* (FIG. 6). With the sliding of the slider 40, the oppositely-positioned meshing portions 31*b* (FIG. 6(*a*)) are meshed with each other such that the engagement pieces 34*b* (FIG. 6(*a*)) of the oppositely-positioned elements form the engagement portions Kb (FIG. 6(*b*)) and the engagement holding pieces 36*b* (FIG. 6(*a*)) of the oppositely-positioned elements form the engagement holding portions Rb (FIG. 6(*b*)), whereby the second fastener unit 12*b* is formed.

By pushing the engagement portions Kb of the formed first fastener unit lib into the engagement holding portions Rb of the formed second fastener unit 12*b*, the engagement holding portions Rb are flexed due to elasticity of the engagement holding pieces 36*b*. Hence, as illustrated in FIG. 11, both the slide fasteners can be stacked one above the other by pushing-in even after closing them.

Figure 11:
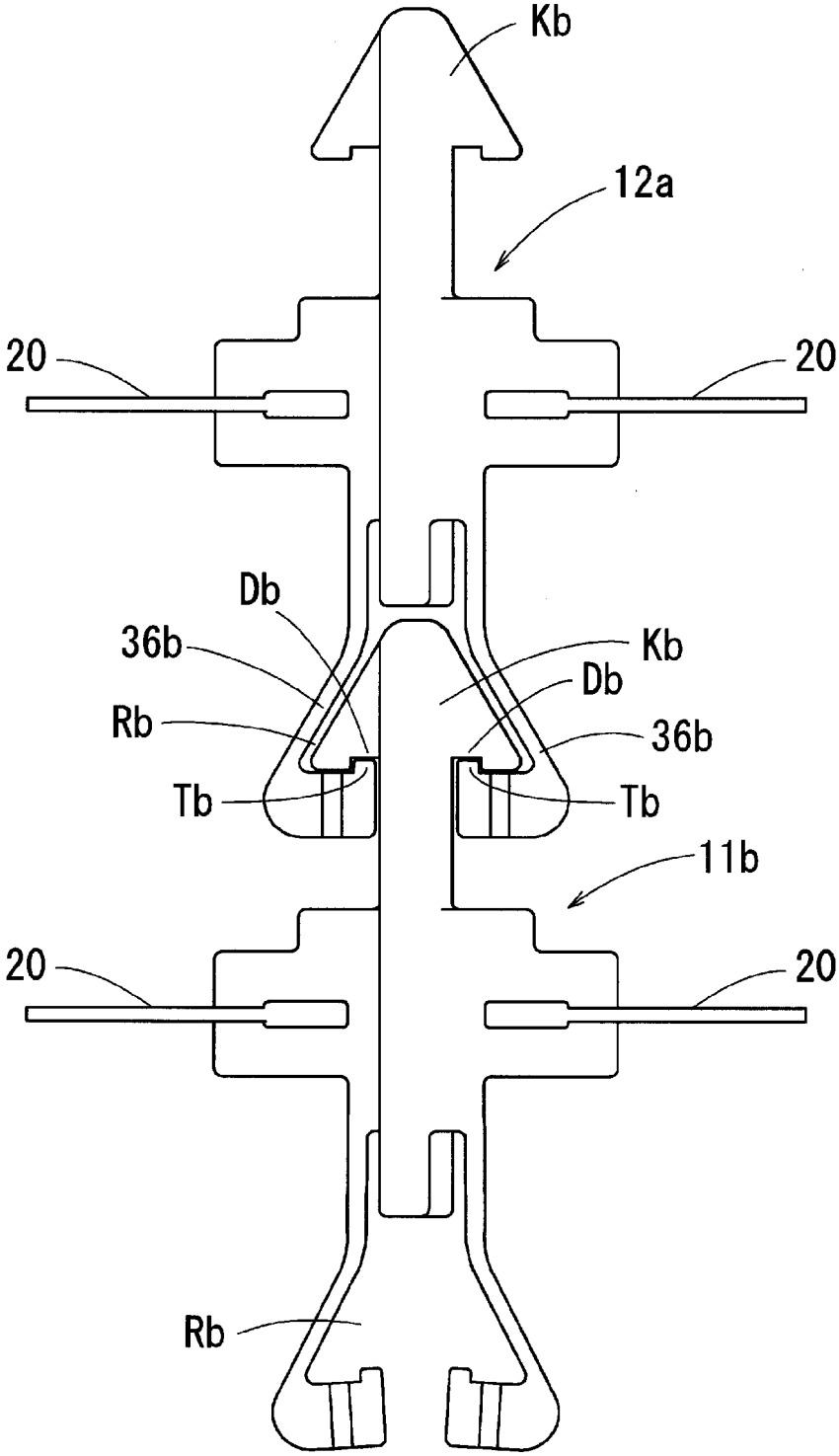

Further, as illustrated in FIG. 11, the engagement portions Kb of the first fastener unit 11*b* are grasped by the engagement holding portions 36*b* of the fastener units 12*b* with elasticity thereof from the left and the right, and the projections Tb of the engagement holding portions Rb of the second fastener unit 12*b* are engaged in the recesses Db that are formed, at the underside of the arrow-head shape, in the engagement portions Kb of the first fastener unit lib. Accordingly, the stacked first and second fastener units are not easily disengaged from each other.

Thus, a novel slide fastener having a multilayered structure made up of plural fastener units can be obtained by separately forming each the plural fastener units by meshing the respective elements with each other, and pushing the engagement portions Kb of the first fastener unit lib into the engagement holding portions Rb of the second fastener units 12*b*. Moreover, in this second embodiment, the multilayered structure can also be formed by sliding the second fastener unit 12*a* so as to grasp the engagement portions Ka of the first fastener unit 11*a* as in the first embodiment instead of pushing-in the engagement portions into the engagement holding portions.

Figure 12:
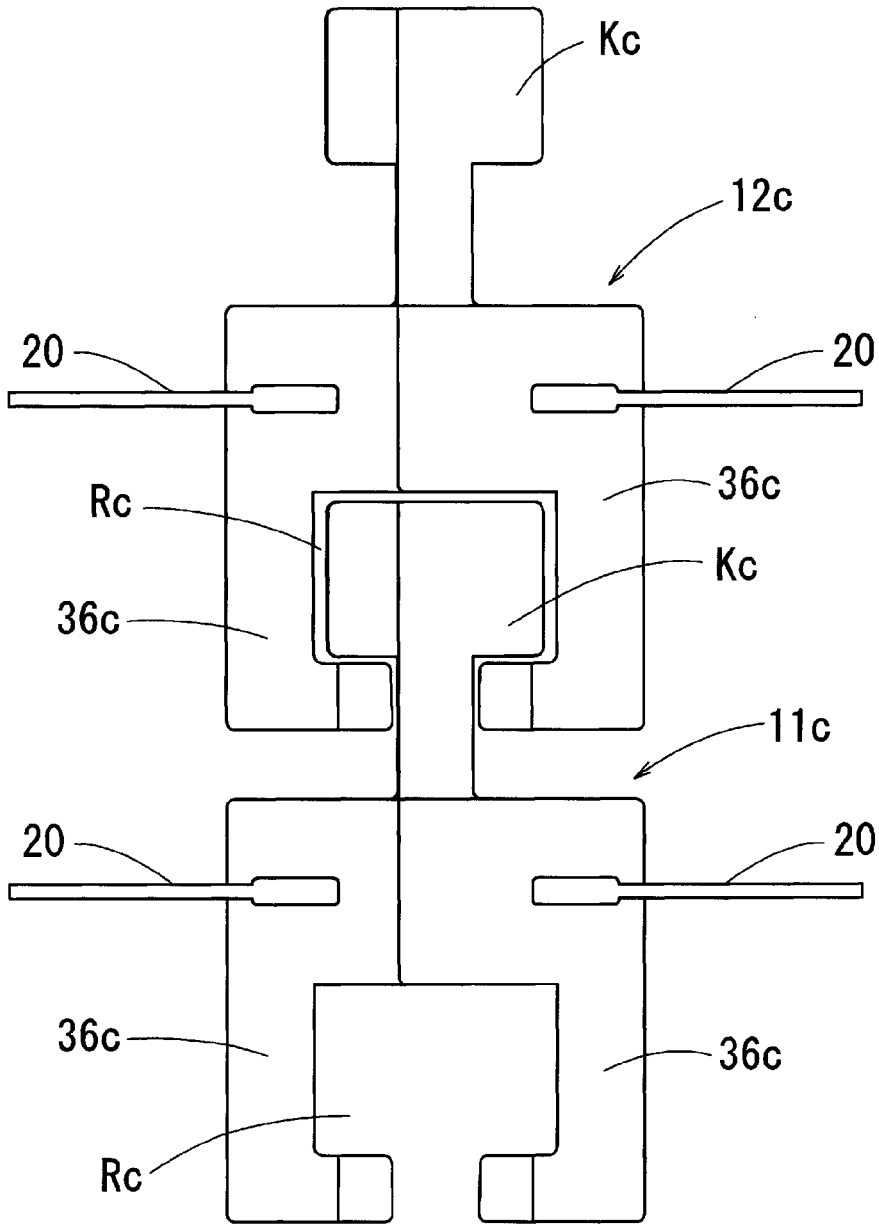
FIG. 12 is an explanatory view illustrating a state where fastener units using the elements according to the third embodiment are overlaid one above another.

FIG. 12 illustrates a state where fastener units 11*c* and 12*c* using the elements 30*c* (FIG. 7(*a*)) according to the third embodiment are overlaid one above the other. The elements 30*c* (FIG. 7(*a*)) are arranged to oppositely face each other, and a slider (not shown) is slid along not only an element passage (not shown) in an upper vertical case (not shown) of a slider body (not shown), which has a shape defined in a similar manner to the first and second embodiments, between the meshing portions 31*c* (FIG. 7(*a*)) and the upwards-extended engagement pieces 34*c* (FIG. 7(*a*)), but also along an element passage (not shown) in a lower vertical case (not shown) of the slider body (not shown) between the meshing portions 31*c* (FIG. 7(*a*)) and the downwards-extended engagement pieces 36*c* (FIG. 7(*a*)). With the sliding of the slider, the oppositely-positioned meshing portions 31*c* (FIG. 7(*a*)) are meshed with each other such that the engagement pieces 34*c* (FIG. 7(*a*)) of the oppositely-positioned elements form the engagement portions Kc (FIG. 7(*b*)) and the engagement holding pieces 36*c* (FIG. 7(*a*)) of the oppositely-positioned elements form the engagement holding portions Rc (FIG. 7(*b*)), whereby the first fastener unit 11*c* is formed.

Similarly, the other elements 30*c* (FIG. 7(*a*)) are arranged to oppositely face each other, and another slider (not shown) is slid along not only an element passage (not shown) in an upper vertical case (not shown) of a slider body (not shown) between the meshing portions 31*c* (FIG. 7(*a*)) and the upwards-extended engagement pieces 34*c* (FIG. 7(*a*)), but also along an element passage (not shown) in a lower vertical case 52 of the slider body (not shown) between the meshing portions 31*c* (FIG. 7(*a*)) and the downwards-extended engagement pieces 36*c* (FIG. 7(*a*)). With the sliding of the slider, the oppositely-positioned meshing portions 31*c* (FIG. 7(*a*)) are meshed with each other such that the engagement pieces 34*c* (FIG. 7(*a*)) of the oppositely-positioned elements form the engagement portions Kc (FIG. 7(*b*)) and the engagement holding pieces 36*c* (FIG. 7(*a*)) of the oppositely-positioned elements form the engagement holding portions Rc (FIG. 7(*b*)), whereby the second fastener unit 12*c* is formed.

When the second fastener unit 12*c* is formed, the engagement holding portions Rc of the second fastener unit 12*c* can be engaged with the engagement portions Kc of the first fastener unit 11*c* in gripping relation such that the second fastener unit 12*c* is overlaid on the first fastener unit 11*c*.

Thus, a novel slide fastener can be provided which has a multilayered structure made up of plural fastener units by overlaying one fastener unit overlaid on another fastener unit, i.e., by engaging the engagement holding portions of a new fastener unit with the engagement portions of a preceding fastener unit in succession. Moreover, in this third embodiment, since the distal end of the engagement portion Kc has the flat head shape including the flat surface Hc for each element, the engagement portion can be prevented from being unintentionally pushed into and engaged with the engagement holding portion by an external force between the plural fastener units that are independently meshed with each other.

As described above, the present invention can provide the novel slide fastener having the multilayered structure made up of plural fastener units with one fastener unit overlaid on another fastener unit in succession, by creating the fastener element having the specific shape based on the novel idea.

The invention claimed is:

1. A slide fastener, comprising:

a plurality of fastener units, each of the plurality of fastener units including fastener tapes comprising elements which are arranged in a line along oppositely-faced edges of opening/closing ends of the fastener tapes, each of the elements comprising a horizontal section having a meshing portion on one side and a fastener-tape fixed portion on the other side, in the horizontal direction, an upper vertical section having an engagement piece extending perpendicularly upwards from the meshing portion of the horizontal section, and a lower vertical section having an engagement holding piece extending perpendicularly downwards from the fastener-tape fixed portion of the horizontal section, and a slider in which the elements are arranged to oppositely face each other and in which the meshing portions of the elements are meshed with each other by sliding the slider between oppositely-faced elements, whereby the engagement pieces of the oppositely-faced elements form an engagement portion and the engagement holding pieces of the oppositely-faced elements form an engagement holding portion, wherein the plurality of fastener units are multilayered such that the engagement holding portions of a first fastener unit among said plurality of fastener units can be engaged with the engagement portions of a second fastener unit among said plurality of fastener units, and wherein the engagement holding portions of a third fastener unit can be engaged with the engagement portions of the second fastener unit, whereby the engagement portions of the plurality of fastener units are formed in succession.

2. The slide fastener according to claim 1, wherein the engagement pieces of the elements are pointed such that when the oppositely-faced elements are meshed, the engagement portion which is formed has an arrow-head shape including a pointed tip at a distal end thereof, and wherein the engagement holding pieces of the elements have a hook shape, such that when the oppositely-faced elements are meshed, the engagement holding portion which is formed has a pyramidal shape for engagement with the engagement portion.

3. The slide fastener according to claim 1, wherein the engagement pieces of the elements are pointed such that when the oppositely-faced elements are meshed, the engagement portion which is formed has an arrow-head shape including a pointed tip at a distal end thereof, wherein the engagement pieces of the elements are shaped such that when the oppositely-faced elements are meshed, recesses are formed on an underside of the arrow-head shape, wherein the engagement holding pieces of the elements have a hook shape including a projection, such that when the oppositely-faced elements are meshed, the engagement holding portion which is formed has a pyramidal shape for engagement with the engagement portion, wherein the engagement holding pieces have elasticity, and wherein the engagement portion having the arrow-head shape can be engaged with the engagement holding portion by pushing the engagement portion into the engagement holding portion, whereby the projections of the engagement holding pieces are engaged with the recesses of the engagement pieces.

4. The slide fastener according to claim 1, wherein the engagement pieces of the elements each have a flat surface at a distal end thereof such that when the oppositely-faced elements are meshed, the engagement portion which is formed has a flat head shape, wherein the engagement holding pieces of the elements have a square-channel shape, such that when the oppositely-faced elements are meshed, the engagement holding portion which is formed has a parallelpiped shape, and wherein the engagement portion having the flat head shape is prevented from being pushed in and engaged with the engagement holding portion by an external force.

* * * * *